US008201310B1

(12) United States Patent
Abdi et al.

(10) Patent No.: US 8,201,310 B1
(45) Date of Patent: Jun. 19, 2012

(54) CO-MOLDED PLASTIC PINCH CLIP

(75) Inventors: Abraham Abdi, Orange, CA (US); Muna Abdi, Long Beach, CA (US); Charles L. Coulter, Riverside, CA (US)

(73) Assignee: Merrick Engineering Inc, Corona, CA (US)

( * ) Notice: Subject to any disclaimer, the term of this patent is extended or adjusted under 35 U.S.C. 154(b) by 1849 days.

(21) Appl. No.: 11/116,582

(22) Filed: Apr. 29, 2005

(51) Int. Cl.
*A44B 21/00* (2006.01)

(52) U.S. Cl. ..... 24/507; 24/499

(58) Field of Classification Search ..... None
See application file for complete search history.

(56) References Cited

U.S. PATENT DOCUMENTS 5,075,935 A * 12/1991 Abdi ..... 24/511
5,183,191 A * 2/1993 Garrison et al. ..... 223/96
5,765,820 A * 6/1998 Marusiak ..... 269/6
6,842,951 B1 * 1/2005 Barre et al. ..... 24/499

* cited by examiner

*Primary Examiner* — Jack W. Lavinder
(74) *Attorney, Agent, or Firm* — G. Donald Weber, Jr.

(57) ABSTRACT

A co-molded plastic pinch clip with certain portions thereof formed from different materials. The clip is adapted to be secured to the body of a hanger, to a clothesline, or any other suitable element. The clip comprises a pair of complementary jaw members formed of a relatively hard plastic material joined together by a bridge-like member. The bridge-like member is joined, at each end, to the middle portion of each of the complementary jaw members by means of a living hinge. A substantially rigid, resilient member engages and presses against the outer surfaces of the complementary jaw members to maintain the relative positions thereof and, as well, force them into engagement at one end. Each jaw member includes a relatively soft plastic pad on the opposite sides of the opposite ends thereof such that a pair of soft plastic pads are disposed in abutting relationship at the inner engagable ends of the clip and a pair of soft plastic pads are disposed at the outer pressable ends of the clip.

18 Claims, 2 Drawing Sheets

CO-MOLDED PLASTIC PINCH CLIP

BACKGROUND

1. Field of the Invention

This invention relates, generally, to molded plastic pinch clips and, more specifically, to pinch clips with co-molded, soft plastic sections thereof for improved operation and utility.

2. Prior Art

Pinch clips are known in the art. For example, U.S. Pat. Nos. 4,878,276; 5,075,935; 2,471,606; inter alia, each describes a pinch clip with a resilient spring member for compressing a pair of opposed jaws. However, each of these patents describes a clip which is fabricated of a relatively hard plastic material which is difficult to use because of distress to the fingers of the user and, as well, possible damage to the items, such as clothing, which are held in place by the clips.

That is, the hard plastic gripping ends of known pinch clips, typically, have ridges or grooves to ensure a secure grip on the items held by the clip. These ridges or grooves can snag or tear the item especially, if the item is a piece of clothing or the like. Alternatively, the grooves and ridges can frequently scratch other types of items retained by the clip.

On the other hand, the clips known in the art and described in the referenced patents create pressure on the fingers of the users. These clips frequently have knobs or buttons protruding from the outer surface of the clip or alternatively have openings in the surface thereof which tend to irritate the fingertips of the user. Improved clip designs are, therefore, desirable.

SUMMARY OF THE INSTANT INVENTION

The preferred embodiment of the clip of this invention comprises a pair of jaws formed of a first, relatively hard, plastic material; a resilient spring formed of a second relatively hard, but resilient, plastic material; and a plurality of pads formed of a third, relatively soft, plastic material mounted on each of said jaws. The second plastic material has a higher tensile strength than the first plastic material. The third plastic material is softer than the other plastic materials and exhibits a higher coefficient of friction, as well. Each of the jaws is a generally planar member comprising an enlarged first end portion defining a finger grasping section with a pad of the resilient plastic material on an outer surface thereof, an intermediate portion, and a second end portion including another section with a pad of the resilient plastic material on an inner surface of the jaw member. The intermediate portions of a pair of jaws are joined together by a bridge member which, preferably, includes an arcuate recess of the underside thereof for receipt of a portion of the periphery of a supporting device, such as a clothesline, or other similar element. The bridge member is integrally joined to and formed with the jaw members by living hinges. The spring is provided in the form of a generally inverted, U-shaped member having a pair of inwardly flared legs. When mounted on the clip, the spring (or resilient member) is operative to engage and retain the jaws in alignment and, as well, to force the jaws together at one end thereof in order to grasp an article therebetween. The arcuate recess is adapted to mount on the arm of a hanger (or similar elongated element) so that the clip can readily slide thereal-ong and pivot thereabout without being removed therefrom. The resilient pads which provide ease in gripping by the user and improved grasping by the clip, are co-molded along with the jaws portion of the clip.

DESCRIPTION OF PREFERRED EMBODIMENTS

Figure 1:
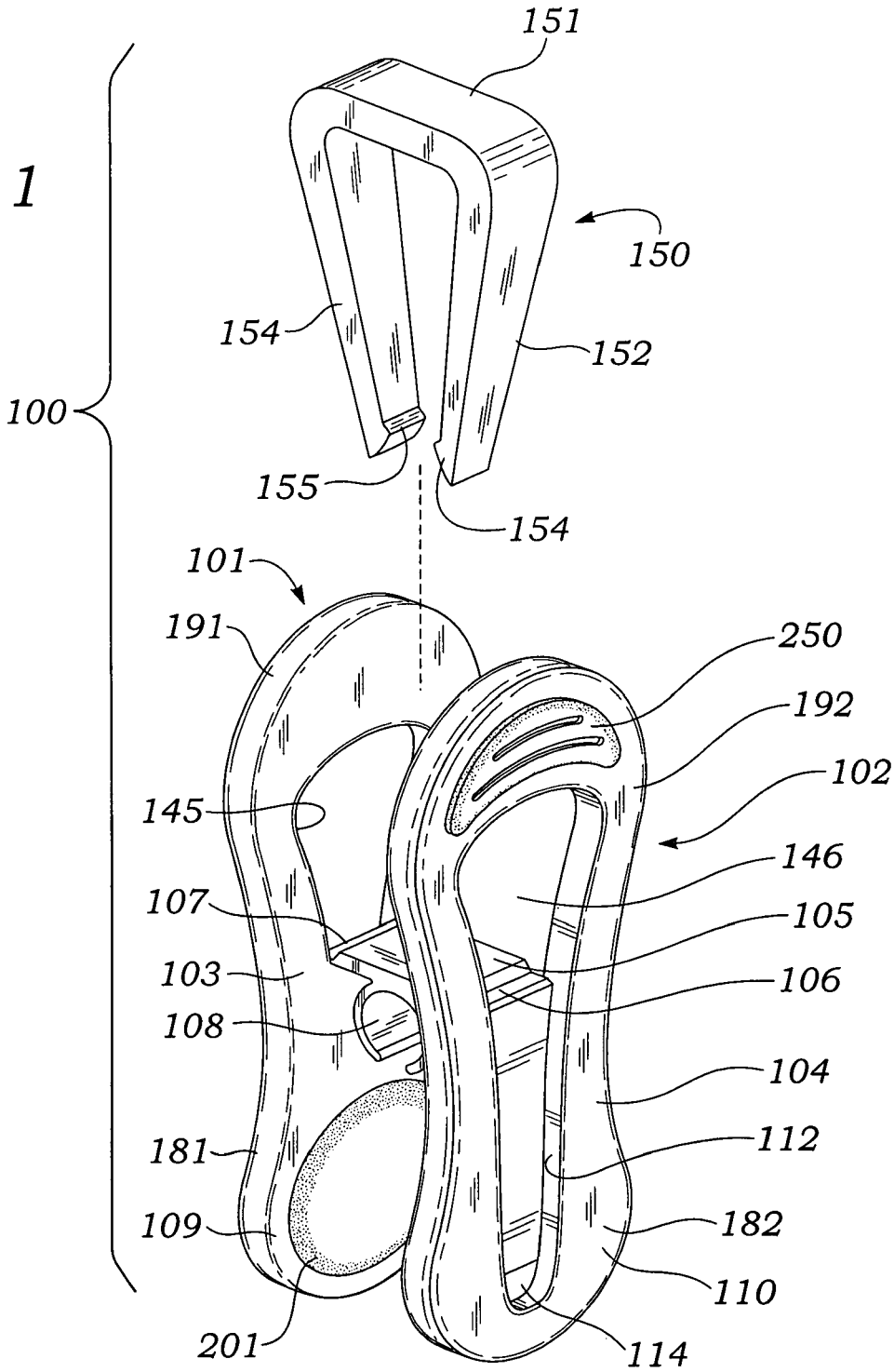
FIG. 1 is an exploded, perspective view of a preferred embodiment of the clip of the instant invention.

For convenience, in the several Figures, like reference characters refer to like components.

Figure 2:
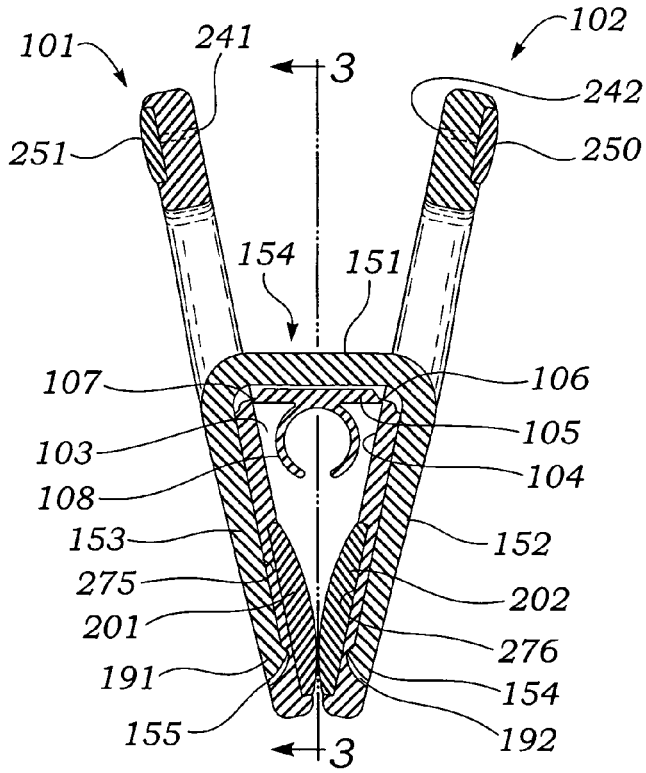
FIG. 2 is a cross sectional view of the embodiment of the clip shown in FIG. 1 in the assembled state.

Referring concurrently to FIGS. 1 and 2, there is shown an exploded, perspective view of the clip 100 and a cross sectional view of the assembled clip, respectively. The clip 100 comprises a pair of facing, complementary jaws 101 and 102 with an intermediate bridge 105 connecting the jaws to one another. The jaws are connected to bridge 105 by living hinges 106 and 107.

In addition, arcuate recess 108 is formed on the underside of bridge 105 and is suitably configured to receive at least a portion of the periphery of a hanger arm or any other element having a circular (or cylindrical) configuration.

As can be seen in FIGS. 1 and 2, the angular extent of the arcuate recess 108 is somewhat less than 360 degrees. The gap in the arcuate recess and the relative flexibility of the segments thereof permits the recess 108 to releasably grip an external longitudinal support (not shown). The arcuate recess 108 of the clip 100 prevents the clip from easy disconnection from of the external support even when the clip 100, per se, is not fully closed.

A resilient, positioning element, referred to as spring 150, has a generally inverted U-shape and is adapted to be mounted over the bridge 105 and adjacent to the outer surface of jaws 102 and 120. In particular, the underside of the base 151 of the spring 150 is placed snugly against the upper surface of bridge 105 while the legs 152 and 153 of the spring bear against and engage the outer surfaces of the jaws 102 and 101, respectively. The spring 150 is designed to force the lower ends of the jaws 101 and 102 together.

Each of the jaws 101 and 102 is formed of a plastic material which is low cost, lightweight, durable and strong. The spring 150 is formed of a plastic material which, preferably, exhibits a higher tensile strength and resilience than the material used to fabricate the jaws 102 and 120. In a preferred embodiment, the jaws 102 and 120 are formed of polypropylene, while the spring 150 is formed of polycarbonate. Of course, other suitable materials can be utilized, if desired.

It is seen that each jaw 102 and 120 is formed in a substantially planar, generally "figure-8" configuration. While not specifically limited thereto, each jaw includes a relatively large upper end portion 191 or 192, a narrowed intermediate portion 103 or 104 and a bottom end portion 109 or 110 which is larger than the intermediate portion but smaller than the upper end portion.

The intermediate portion of each jaw includes a relatively planar portion 103 or 104 which is co-planar with the inner surface of the respective jaw. The upper ends of planar portions 103 and 104 are connected to the bridge 105 (shown in cross-section in FIG. 2) which extends between the two jaws. The planar portions 103 and 104 are joined to the opposite ends of the bridge 105 by the respective living hinges 106 and 107. Thus, the jaws 101 and 102 can freely pivot around the ends of the bridge 105.

Figure 4:
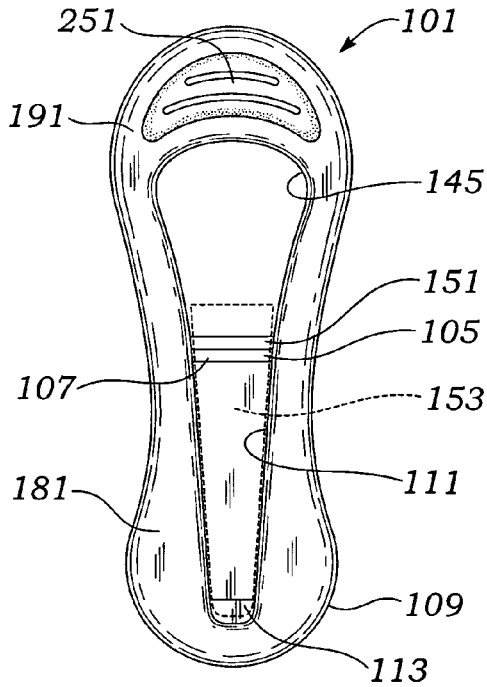
FIG. 4 is a plan view of the inner surface of the jaws of the clip of the instant invention.

As seen best in FIGS. 1 and 4, an elongated recess 112 is formed within the outer surface of lower jaw portion 110. A locking recess 114 is located at the end of recess 112 of the jaw 102 adjacent to the planar surface portion 104. Locking recess 114 is adapted to receive a locking end 154 of the spring 150 (shown best in FIG. 2) to secure the two jaws and the spring to each other.

It is understood that a similar recess 111 and locking recess 113 is found in the outer surface of jaw 101 to receive leg 153 and locking end 155 of spring 150.

As best seen in FIG. 2, the jaws 102 and 120 are arranged to be disposed face-to-face, with the bridge element 105 forming a connection therebetween. The spring 150 surrounds a portion of the opposed jaws and bridge 105 so as to maintain the configuration of the clip and to force the bottom ends 109 and 110 of the clip 100 together.

As best seen in FIGS. 1 and 2, the spring 150 (or resilient bias means) has a generally inverted U-shape having a pair of inwardly flaring legs 152 and 153 joined together by a planar mid-portion 151. Each of the legs terminates at its free end in an enlarged semi-circular projection 154 or 155 which is adapted to be received within a respective one of the locking recesses 113 or 114 in the grooves 111 or 112 in jaws 101 and 102, respectively.

Figure 3:
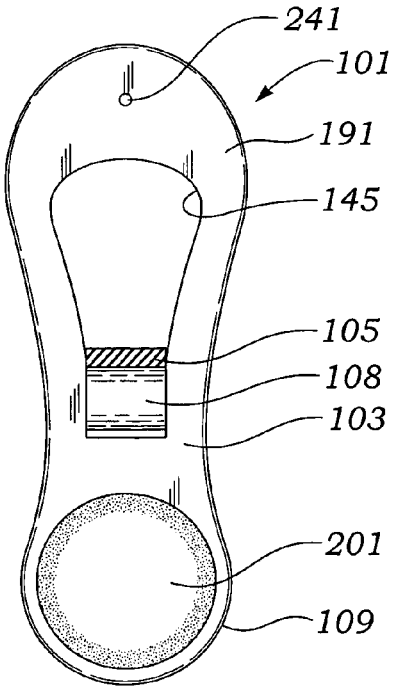
FIG. 3 is a plan view of the outer surface of the jaws of the clip of the instant invention.

Referring now to FIGS. 3 and 4, there are shown the inner and outer surfaces, respectively, of either jaw 101 or 102. Inasmuch as the jaws are identical in construction, only jaw 101 is shown for convenience, however, the reference numeral for the counterpart component of jaw 102 is shown in parentheses. The enlarged upper end portion 191 (or 192) of the jaw 101 (or 102), is generally of oval construction and includes an opening 145 (or 146). The opening 145 (or 146) is suitably dimensioned so that the leg 153 (or 152) of the spring 150 is comfortably received therein, when being assembled with both of the jaws 101 and 102.

The outer surface of the end portion 191 (and 192) includes a pad or cushion 251 seen best in FIG. 2 (or 252). The pad or cushion 251 (or 252) is, typically, fabricated of a material such as PTE which is a relatively soft, resilient plastic material. The pad 251 (or 252) is co-molded along with the jaw 101 (and 102) on the outer surfaces thereof, respectively. The bridge 105 is formed integrally with the jaws.

Preferably, the pad 251 (or 252) extends across a substantial portion of the width (or diameter) of the end portion 191 (or 192). In some instances, a shallow depression can be formed in the end portion 191 (or 192) of the jaw 101 (or 102) to receive the respective pad 251 (or 252). The pad is, typically, adhered to the jaw by thermal bonding during manufacturing process.

In some instances, a portion of the pad 251 (or 252) can be engaged in an aperture 241 (or 242) which passes through the upper end portion 191 (or 192) of the jaw. The pads 251 (or 252) increase frictional engagement between the clip and the fingertips of the user but do not harm, snag and/or hurt the user. Thus, the jaws 101 (and 102) can be grasped comfortably at the pads or cushions 251 (and 252) on the large ends thereof to facilitate the opening of the clip 100.

The smaller end portions 181 (and 182) of the jaws 101 (and 102), respectively, are generally circular in configuration. The inner surface of the end portion 109 (or 110) includes a pad or cushion 201 (or 202). The pad or cushion 201 (or 202) is, typically, fabricated of a material such as PTE which is relatively soft, resilient plastic material. The pad 201 (or 202) is co-molded along with the jaws 101 (and 102) on the inner surfaces thereof, respectively.

Preferably, the pad 201 (or 202) extends across a substantial portion of the width (or diameter) of the smaller end portion 109 (or 110). In some instances, a shallow depression 275 (or 276) seen best in FIG. 2, can be formed in the end portion 109 (or 110) of the jaw 101 (or 102) to receive the respective pad 201 (or 202). The pad 201 (or 202) is, typically, adhered to the jaw 101 (or 102 by thermal bonding during the manufacturing process. The pad 201 (or 120) is adapted to engage and hold a garment (or other item not shown) securely therebetween under the bias force provided by the spring 150. The pads 201 or 202 increase frictional engagement between the clip 100 and the garment or other item but do not harm, snag and/or deface the garment or item.

As seen best in FIG. 2, gap 191 (or 192) is provided adjacent to the end of leg 152 (or 153) in recess 113 (or 114) in each jaw member in order to permit the spring 150 to be selectively removed from the jaw members by insertion of a suitable tool between the end of the leg and the end of the groove 111 (or 112).

In the assembly of the clip 100, the pair of jaws 101 and 102 are located at opposite ends of the bridge 105. The inverted U-shaped spring 150 is slipped over the bridge 105 so that the projections 154 and 155 engage the grooves 111 and 112 in the outer surfaces of the planar portions 103 and 104 of the jaws. By pushing on the mid-portion 151 of the resilient means 150 toward the jaw ends 109 and 110, the spring 150 slides toward those ends, with the portions 154 and 155 of the spring sliding along the surfaces of the grooves 111 and 112 until the projections reach the recesses 113 and 114 in the grooves. When this occurs, the projections 154 and 155 snap into the recesses 113 and 114, thereby locking the spring 150 in place.

The spring 150 then forces the jaw ends 109 and 110 toward each other. Once the clip components are secured, there is sufficient frictional engagement between the pads 201 and 202 of the jaw ends 109 and 110 for the clip 100 to operate properly. In addition, when attached via the arcuate surface 108. Clip 100 can be readily slid along an arm of a hanger (or the like) when desired, but is resistant to accidental sliding. Moreover, the clip 100 can be pivoted through an arc of 360 degree about the longitudinal axis of the support which is journalled within the opening of the arcuate recess 108 with minimal likelihood of detachment.

Thus, the opposed end portions 109 and 110 with the co-molded pads 201 and 210 form a gripper for the clip 100 which can be opened to receive a garment (or any other item). As described above, the clip 100 is opened by grasping the clip by the upper end portions 191 and 192 of the loops 102 and 120 at the pads 250 and 251 and squeezing those end portions toward each other against the bias force of spring 150. Upon release of the upper end portions, the spring 150 forces the lower ends 109 and 110 of the jaws back together to effect the holding of an item tightly between the pads 201 and 202 on the lower jaw ends 109 and 110.

Thus, there is shown and described a unique design and concept of a pinch clip with co-molded pads for advantageous utilization. The particular configuration shown and described herein relates to a preferred embodiment. While this description is directed to a particular embodiment, it is understood that those skilled in the art may conceive modifications and/or variations to the specific embodiments shown and described herein. Any such modifications or variations which fall within the purview of this description are intended to be included therein as well. The description herein is intended to be illustrative only and is not intended to be limitative. Rather, the scope of the invention described herein is limited only by the claims appended hereto.

The invention claimed is:

1. A clip comprising, a pair of jaws, each of said jaws comprising a generally planar member including a first end portion, an intermediate portion, and a second end portion, each of said first and second end portions having an inner surface area and an outer surface area, a bridge member joined to the intermediate portion of each of said jaws by hinge means, resilient bias means, said resilient bias means comprising a member having a base and a pair of inwardly flared legs mounted to said base, each of said flared legs of said bias means terminating in a free end, said base of said bias means overlying said bridge member, said free ends of said flared legs of said resilient bias means adapted to be readily secured to said jaws such that said flared legs force said second end portions of said jaws into engagement with each other, first co-molded pad components integrally formed at the outer surface of each of said first end portions of each of said jaws and, second co-molded pad components formed at the inner surface of each of said second end portions of each said jaws.

2. The clip of claim 1 wherein, each of said jaws is in the form of a substantially planar loop.

3. The clip recited in claim 1 wherein, said second end portion of said jaw is larger than said first end portion.

4. The clip recited in claim 1 wherein, said bridge member includes an arcuate recess for selectively receiving a support element therein.

5. The clip recited in claim 4 wherein, said arcuate recess is adapted to provide a friction fit with an external support element.

6. The clip recited in claim 1 wherein, said arcuate recess is disposed on the underside of said bridge member.

7. The clip recited in claim 1 including, a groove formed in the outer surface area of said second end portion of each of said jaws in order to receive the free ends of said inwardly flared legs of said bias means.

8. The clip recited in claim 7 wherein, each said groove is formed in the second end portion of the respective jaw.

9. The clip recited in claim 7 wherein, said groove in said second end portions of each jaw includes a depression therein, and each of said free ends of said bias means includes an enlarged section which engages the depression in the respective second end portion of said jaw.

10. The clip recited in claim 1 wherein, each of said pair of jaws and said bridge member is formed of a first plastic material.

11. The clip recited in claim 10 wherein said first plastic material is polypropylene.

12. The clip recited in claim 1 wherein, said resilient bias means is formed of a second plastic material.

13. The clip recited in claim 12 wherein;

said second plastic material is polycarbonate.

14. The clip recited in claim 1 wherein, each of said co-molded pad components is formed of a third plastic material.

15. The clip recited in claim 14 wherein, said third plastic material is PTE.

16. The clip recited in claim 1 wherein, each of said co-molded pad components is adhered to the respective jaw by means of thermal bonding.

17. A clip comprising, a pair of jaws formed of a first, relatively hard, plastic material;

a resilient spring formed of a second relatively hard, but resilient, plastic material; and a plurality of pads formed of a third, relatively soft, plastic material mounted on each of said jaws;

each of said jaws is a generally planar member comprising an enlarged first end portion defining a finger grasping section with a pad of the third plastic material on an outer surface thereof, an intermediate portion, and a second end portion including another section with a pad of the third plastic material on an inner surface of the jaw, said intermediate portions of said pair of jaws are joined together by a bridge member which, includes a recess on the underside thereof for receipt of a portion of the periphery of a supporting device, said bridge member is integrally joined to and formed with the jaw members by living hinges;

said resilient spring is provided in the form of a generally inverted, U-shaped member having a pair of inwardly flared legs and operative to engage and retain the pair of jaws in alignment and, as well, to force the jaws together at one end thereof in order to grasp an article therebetween;

said soft resilient pads provide ease in gripping by the user and improved grasping by the clip, are co-molded and integrally formed with the jaws.

18. The clip recited in claim 17 wherein, said second plastic material has a higher tensile strength than the first plastic material, said third plastic material is softer than said first and second plastic materials and exhibits a higher coefficient of friction, as well.

* * * * *